US007317387B1

(12) United States Patent
Cova et al.

(10) Patent No.: US 7,317,387 B1
(45) Date of Patent: Jan. 8, 2008

(54) METHOD AND APPARATUS FOR INCREASED CONTAINER SECURITY

(75) Inventors: Nicholas D. Cova, El Cerrito, CA (US); Mark S. Weidick, San Francisco, CA (US); Blair B. LaCorte, Belvedere, CA (US)

(73) Assignee: Savi Technology, Inc., Mountain View, CA (US)

( * ) Notice: Subject to any disclaimer, the term of this patent is extended or adjusted under 35 U.S.C. 154(b) by 339 days.

(21) Appl. No.: 10/984,026

(22) Filed: Nov. 8, 2004

Related U.S. Application Data

(60) Provisional application No. 60/518,553, filed on Nov. 7, 2003.

(51) Int. Cl.
*G08B 1/08* (2006.01)
*H04Q 7/00* (2006.01)

(52) U.S. Cl. ..... 340/539.1; 340/539.13; 340/989

(58) Field of Classification Search ..... 340/539.1, 340/539.13, 539.26, 545.1, 551, 989, 539.31
See application file for complete search history.

(56) References Cited

U.S. PATENT DOCUMENTS

| | | | |
|---|---|---|---|
| 3,597,753 | A | 8/1971 | Tabankin |
| 3,665,449 | A | 5/1972 | Elder et al. |
| 3,848,243 | A | 11/1974 | Schirmer |
| 3,878,539 | A | 4/1975 | Gooding |
| 3,961,323 | A | 6/1976 | Hartkorn |
| 4,258,359 | A | 3/1981 | McLamb |
| 4,438,428 | A | 3/1984 | Ober et al. |
| 4,484,181 | A | 11/1984 | Schwartz |
| 4,683,461 | A | 7/1987 | Torre |
| 4,688,244 | A | 8/1987 | Hannon et al. |

(Continued)

FOREIGN PATENT DOCUMENTS

EP 0 467 036 A2 1/1992

(Continued)

OTHER PUBLICATIONS

Nikola Cargonja, Philip J. Keleshian, Roderick E. Thorne and Steven J. Farrell, U.S. Appl. No. 60/464,067, filed Apr. 18, 2003 for "Techniques for Detecting Intrusion Into a Cargo Container".

(Continued)

*Primary Examiner*—Jeffery Hofsass
*Assistant Examiner*—Samuel J. Walk
(74) *Attorney, Agent, or Firm*—Haynes and Boone, LLP

(57) ABSTRACT

One embodiment includes a support configured to resiliently and removably grip a door hinge portion, with circuitry coupled to a wireless communication portion on an exterior side thereof. A different embodiment has a wireless communication portion with two antennas that is supportable on a container by a support so the antennas face in different directions externally of the container. Another embodiment has a detector on a support with a portion configured to extend through a gap between a door frame and a door, and has a blocking portion that can obstruct access to the gap and detector. A further embodiment includes a container with a wall and a movable door, and an antenna in a recess of the wall near the top of the container. Another embodiment includes a container with a door and a vent, and an antenna supported adjacent the vent.

15 Claims, 8 Drawing Sheets

U.S. PATENT DOCUMENTS

| | | | | |
|---|---|---|---|---|
| 4,808,974 | A | 2/1989 | Cantley | |
| 5,072,212 | A | 12/1991 | Sorenson | |
| 5,247,279 | A | 9/1993 | Sato | |
| 5,341,123 | A | 8/1994 | Schuman, Sr. et al. | |
| 5,422,627 | A | 6/1995 | Tap et al. | |
| 5,448,220 | A | 9/1995 | Levy | |
| 5,479,152 | A | 12/1995 | Walker et al. | |
| 5,499,014 | A | 3/1996 | Greenwaldt | |
| 5,572,191 | A | 11/1996 | Lundberg | |
| 5,615,247 | A | 3/1997 | Mills | |
| 5,656,996 | A | 8/1997 | Houser | |
| 5,729,199 | A | 3/1998 | Cooper et al. | |
| 5,844,482 | A | 12/1998 | Guthrie et al. | |
| 5,907,812 | A | 5/1999 | Van De Berg | |
| 5,913,180 | A | 6/1999 | Ryan | |
| 5,917,433 | A * | 6/1999 | Keillor et al. | 340/989 |
| 5,936,523 | A | 8/1999 | West | |
| 5,939,982 | A | 8/1999 | Gagnon et al. | |
| 6,236,911 | B1 | 5/2001 | Kruger | |
| 6,271,753 | B1 | 8/2001 | Shukla | |
| 6,281,793 | B1 * | 8/2001 | Haimovich et al. | 340/545.1 |
| 6,483,473 | B1 | 11/2002 | King et al. | |
| 6,497,656 | B1 | 12/2002 | Evans et al. | |
| 6,512,455 | B2 | 1/2003 | Finn et al. | |
| 6,608,554 | B2 | 8/2003 | Lesesky et al. | |
| 6,736,316 | B2 | 5/2004 | Neumark | |
| 6,744,352 | B2 | 6/2004 | Lesesky et al. | |
| 6,747,558 | B1 * | 6/2004 | Thorne et al. | 340/551 |
| 6,748,292 | B2 | 6/2004 | Mountz | |
| 6,753,775 | B2 | 6/2004 | Auerbach et al. | |
| 6,844,829 | B2 | 1/2005 | Mayor | |
| 6,919,803 | B2 | 7/2005 | Breed | |
| 6,975,224 | B2 | 12/2005 | Galley, III et al. | |
| 7,034,683 | B2 | 4/2006 | Ghazarian | |
| 7,098,784 | B2 * | 8/2006 | Easley et al. | 340/539.13 |
| 2004/0012502 | A1 | 1/2004 | Rasmussen | |
| 2004/0119588 | A1 * | 6/2004 | Marks | 340/539.1 |
| 2004/0174259 | A1 * | 9/2004 | Peel et al. | 340/539.26 |
| 2004/0183673 | A1 * | 9/2004 | Nageli | 340/539.13 |
| 2004/0233041 | A1 | 11/2004 | Bohman et al. | |
| 2004/0263329 | A1 | 12/2004 | Cargonja et al. | |
| 2006/0012481 | A1 | 1/2006 | Rajapakse et al. | |

FOREIGN PATENT DOCUMENTS

| | | |
|---|---|---|
| EP | 0 825 554 A1 | 2/1998 |
| EP | 0 984 400 A2 | 3/2000 |
| WO | WO 98/32092 | 7/1998 |
| WO | WO 01/08116 | 2/2001 |
| WO | WO 01/27891 | 4/2001 |

OTHER PUBLICATIONS

Nikola Cargonja, Philip J. Keleshian, Roderick E. Thorne and Ravindra U. Rajapakse, U.S. Appl. No. 60/496,056, filed Aug. 18, 2003 for "Technique Using Cargo Container Motion as a Factor in Intrusion Detection".

Gustavo Padilla and Roderick E. Thorne, U.S. Appl. No. 60/504,580, filed Sep. 19, 2003 for "Technique Using Cargo Container Door Sensor as a Factor In Intrusion Detection".

Nicholas D. Cova, Mark S. Weidick, and Blair B. LaCorte, U.S. Appl. No. 60/518,553, filed Nov. 7, 2003 for "Method and Apparatus for Increased Container Security".

Ravindra U. Rajapakse, Roderick E. Thorne, Robert Fraser Jennings, Steven J. Farrell and Liping Julia Zhu, U.S. Appl. No. 60/588,229, filed Jul. 15, 2004 for "Method And Apparatus for Effecting Control or Monitoring Within a Container".

Ravindra U. Rajapakse, Steven J. Farrell, Mark S. Weidick, Nicholas D. Cova, John L. Goodell, Edward D. Schultheis, William S. Dawson and Kent G. Merritt, U.S. Appl. No. 10/974,481, filed Oct. 27, 2004 for "Container Security and Monitoring".

Ravindra U. Rajapakse, Steven J. Farrell, Mark S. Weidick, Nicholas D. Cova, John L. Goodell, Edward D. Schultheis and William S. Dawson, U.S. Appl. No. 10/975,035, filed Oct. 27, 2004 for "Security and Monitoring For Containers".

Ravindra U. Rajapakse, Steven J. Farrell, Nicholas D. Cova, Mark S. Weidick, Roderick E. Thorne and Gustavo Padilla, U.S. Appl. No. 60/514,968, filed Oct. 27, 2003 for "Mechanisms for Secure RF Tags on Containers".

Roderick E. Thorne, Philip J. Keleshian, Timothy R. Redler, Joseph S. Chan and Nikola Cargonja, U.S. Appl. No. 60/332,480, filed Nov. 9, 2001 for "Method and Apparatus for Providing Container Security with a Tag".

Steven J. Farrell, Blair B. LaCorte, and Ravindra U. Rajapakse, U.S. Appl. No. 11/158,300, filed Jun. 21, 2005 for "Method and Apparatus for Monitoring Mobile Containers".

Nikola Cargonja, Timothy R. Redler, Richard D. Lockyer and Kent G. Merritt, U.S. Appl. No. 11/266,018, filed Nov. 3, 2005 for "Method and Apparatus for Monitoring the Voltage of a Battery".

Richard D. Lockyer, U.S. Appl. No. 60/732,240, filed Nov. 1, 2005 for "Apparatus and Method for Capacitive Sensing of Door Position".

Richard D. Lockyer and David H. Beauley, U.S. Appl. No. 11/336,402, filed Jan. 20, 2006 for "Method and Apparatus for Capacitive Sensing of Door Position".

* cited by examiner

METHOD AND APPARATUS FOR INCREASED CONTAINER SECURITY

This application claims the priority under 35 U.S.C. §119 of U.S. provisional application No. 60/518,553 filed Nov. 7, 2003, the disclosure of which is hereby incorporated herein by reference.

FIELD OF THE INVENTION

This invention relates in general to monitoring and security for containers and, more particularly, to systems that provide automated monitoring and security for shipping containers.

BACKGROUND

A variety of different products are shipped in cargo containers. Products are packed into the container by a shipper, after which the container doors are closed and then secured with some type of lock. The container is then transported to a destination, where a recipient removes the lock and unloads the container.

The shipper often finds it advantageous to have some form of monitoring while the container is being transported. For example, the cargo within the container may be relatively valuable products such as computers or other electronic devices, and thieves may attempt to break into the container and steal these products if the container is left unattended during transport. Alternatively, the cargo may be products such as fresh fruit, for which it is advantageous to continuously monitor environmental conditions such as temperature and humidity, in order to avoid or minimize spoilage.

It is not cost-feasible to have a person watch a container at all times in order to provide security and/or monitoring. Accordingly, electronic systems have previously been developed to provide a degree of automated security and/or monitoring. Although these pre-existing systems have been generally adequate for their intended purposes, they have not been satisfactory in all respects.

BRIEF DESCRIPTION OF THE DRAWINGS

A better understanding of the present invention will be realized from the detailed description that follows, taken in conjunction with the accompanying drawings, in which.

DETAILED DESCRIPTION

Figure 1:
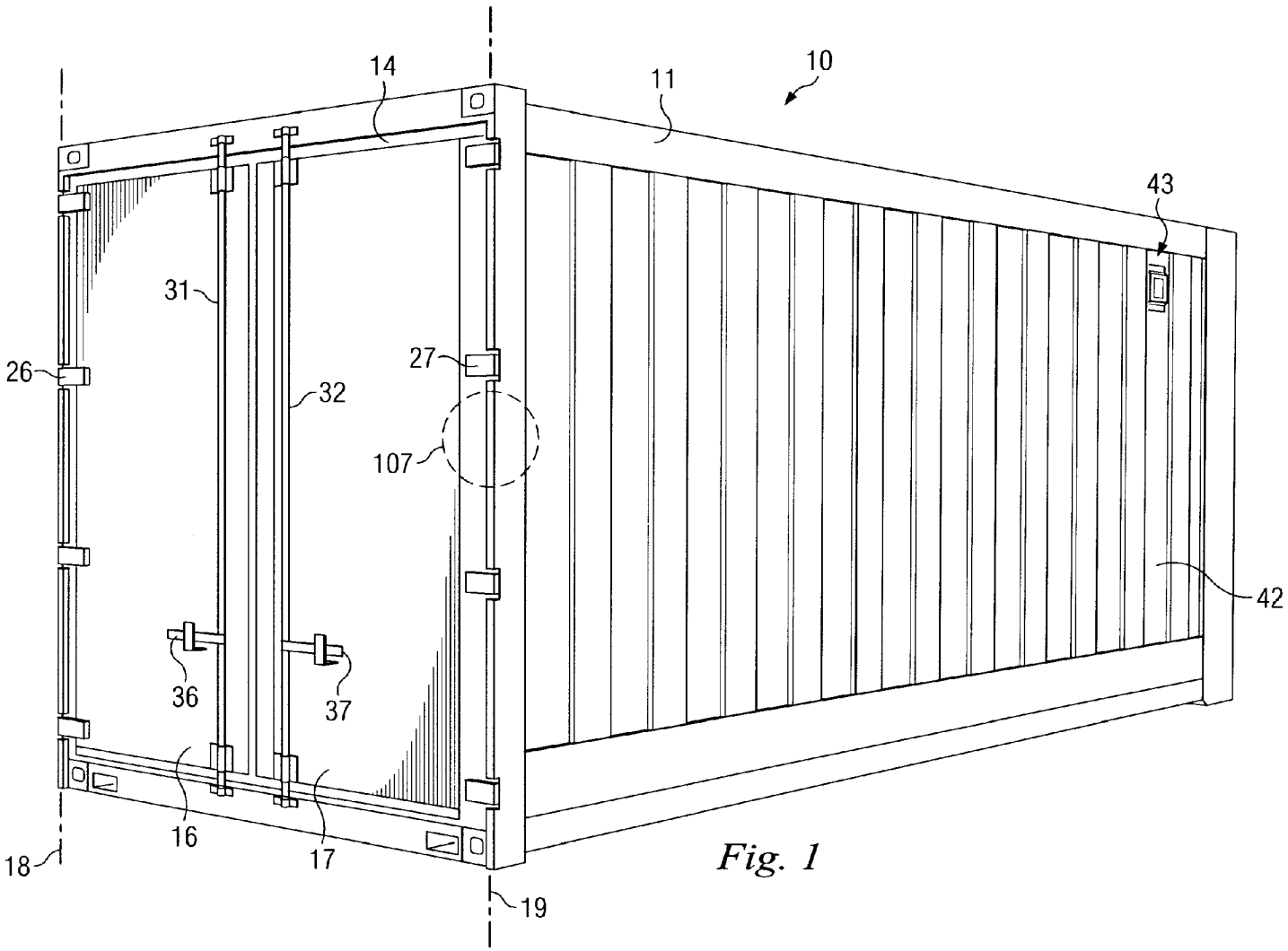
FIG. 1 is a diagrammatic perspective view of an apparatus that embodies aspects of the present invention, and that includes a container with an antenna mounted thereon.

FIG. 1 is a diagrammatic perspective view of an apparatus 10 that embodies aspects of the present invention, and that includes a container 11. The container 11 is a conventional shipping container of a well-known type, and in particular complies with an industry-standard specification known as an ISO 668:1995(E) Series 1 freight container. The vast majority of containers that are currently in commercial use conform to this ISO standard. This particular type of container is shown by way of example. The present invention is not limited to this particular type of container, or to containers in general.

The container 11 is made almost entirely of steel or aluminum, except that a not-illustrated floor within the container may be made of either wood or metal. The container 11 has at one end a large opening 14 of approximately square shape. Two rectangular doors 16 and 17 are supported by respective sets of hinges 26 and 27, and pivot about respective spaced vertical pivot axes 18 and 19. The axes 18 and 19 are located near respective side edges of the opening 14. The doors 16 and 17 are each shown in a closed position in FIG. 1, and can each pivot about 90° to 270° outwardly to an open position, which is not shown in FIG. 1.

In order to releasably secure the doors 16 and 17 in their closed positions, the door 16 has a vertical rod 31 rotatably supported thereon, and the door 17 has a vertical rod 32 rotatably supported thereon. The rods 31 and 32 each have a respective handle 36 or 37 supported thereon. The handles 36 and 37 can be used to manually rotate the rods 31 and 32 between locked and released positions. In the locked position, each handle can engage a retention bracket mounted on the associated door, and the bracket maintains the handle and rod in the locked position. The rods 31 and 32 have dogs at each end and, as each rod is pivoted between its locked and released positions, the dogs thereon can move into or out of engagement with a locking bracket or locking recess provided on the container 11.

Each side wall of the container 11 has a plurality of vertically extending corrugations or recesses, one of which is designated in FIG. 1 by reference numeral 42. A vent/ antenna assembly 43 is provided within the corrugation 42 near an upper end thereof, and is described in more detail with reference to FIG. 2.

Figure 2:
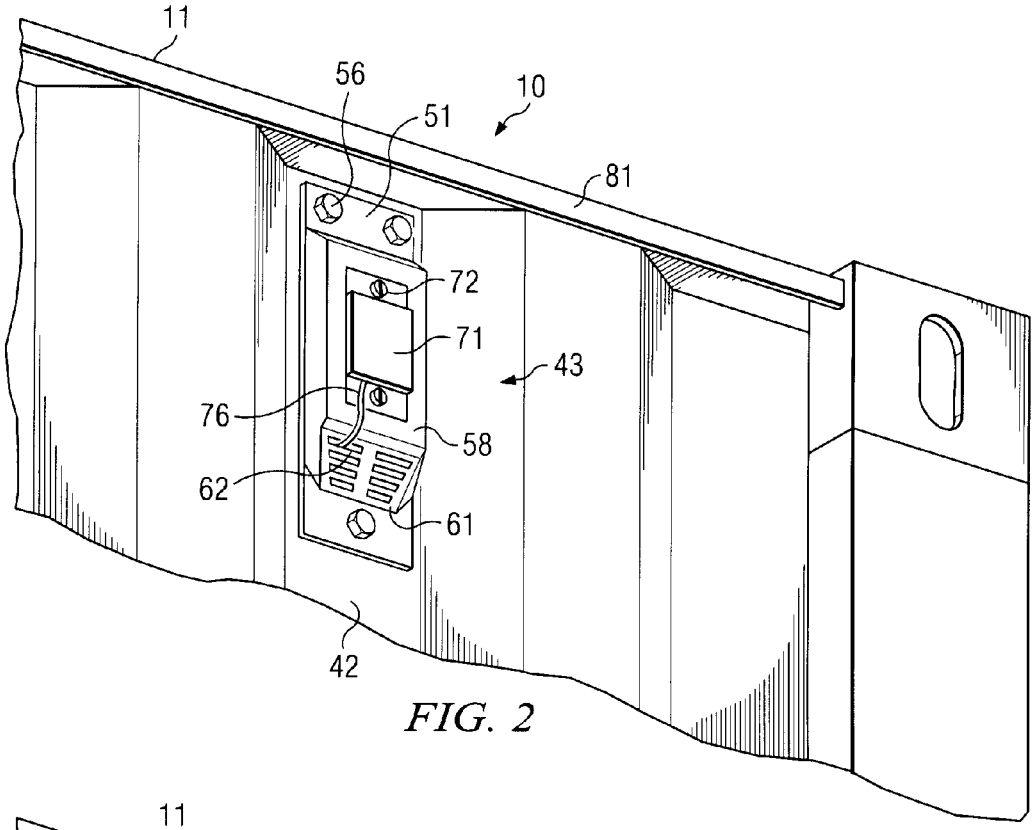
FIG. 2 is a diagrammatic fragmentary perspective view of an upper corner portion of the container of FIG. 1, in a significantly enlarged scale.

More specifically, FIG. 2 is a diagrammatic fragmentary perspective view of an upper corner portion of the container 11 of FIG. 1, in a significantly enlarged scale. The assembly 43 includes a vent cover 51, which is secured to the container wall by several bolts 56. In particular, the vent cover 51 is secured to the flat bottom surface of the corrugation or recess 42. The vent cover 51 includes a vertical surface 58, and also includes an inclined surface 61 that faces downwardly and outwardly. The inclined surface 61 has several slotlike openings 62 through it. The wall of the container 11 has, behind the vent cover 51, a not-illustrated opening which provides communication between the interior of the container and the region within the vent cover 51, so as to provide ventilation between the interior and exterior of the container 11.

A wireless communication portion in the form of an antenna 71 is fixedly secured by screws or bolts 72 to the vertical surface 58 of the vent cover 51. The vent cover 51 and antenna 71 have a combined thickness that is less than the depth of the corrugation or recess 42. A cable 76 has one end electrically coupled to the antenna 71, and extends through one of the openings 62 in the vent cover 51. The other end of the cable 76 is coupled to circuitry of a known type, which is disposed either within the vent cover 51, or inside the container 11.

This not-illustrated circuitry may, for example, include a sensor that monitors environmental conditions within the container 11. If a monitored environmental condition moves outside an acceptable range, the circuitry can use the antenna 71 to transmit a radio frequency (RF) signal. A remote radio receiver known in the industry as a reader can receive this signal, and can initiate appropriate action to address the detected problem. In addition, when products packed within the container 11 carry radio frequency identification (RFID) tags of a known type, the circuitry can receive wireless signals from the tags in order to collect information about the products in the container, and can then use the antenna 71 to transmit wireless signals that contain this information. The remote reader can receive these signals, and will thus have information about the products that are actually present within the container 11.

The location of the antenna 71 that is shown in FIGS. 1 and 2 is advantageous, because it is spaced from hazards close to the ground, and is sufficiently far from upper corners by which the container is lifted so as to reduce the likelihood of damage to the antenna 71 while the container is being moved. Further, it is spaced both horizontally and vertically from the center of the container, by a distance that is sufficient to help reduce the probability of damage to the antenna 71. The antenna 71 is also protected by the fact that it is disposed within the corrugation or recess 42, and is located just below a top rail 81 of the container. The antenna 71 is beyond the arc of the swinging doors 16 and 17 as they are opened. The antenna 71 could be installed on the container while the container is being built, or could be added to a container at a later time in the form of a retrofit. Providing the antenna 71 in the region of the vent cover 51 permits the cable 76 to be routed to the interior of the vent cover 51 or to the interior of the container, through existing openings that are provided for ventilation purposes.

Figure 3:
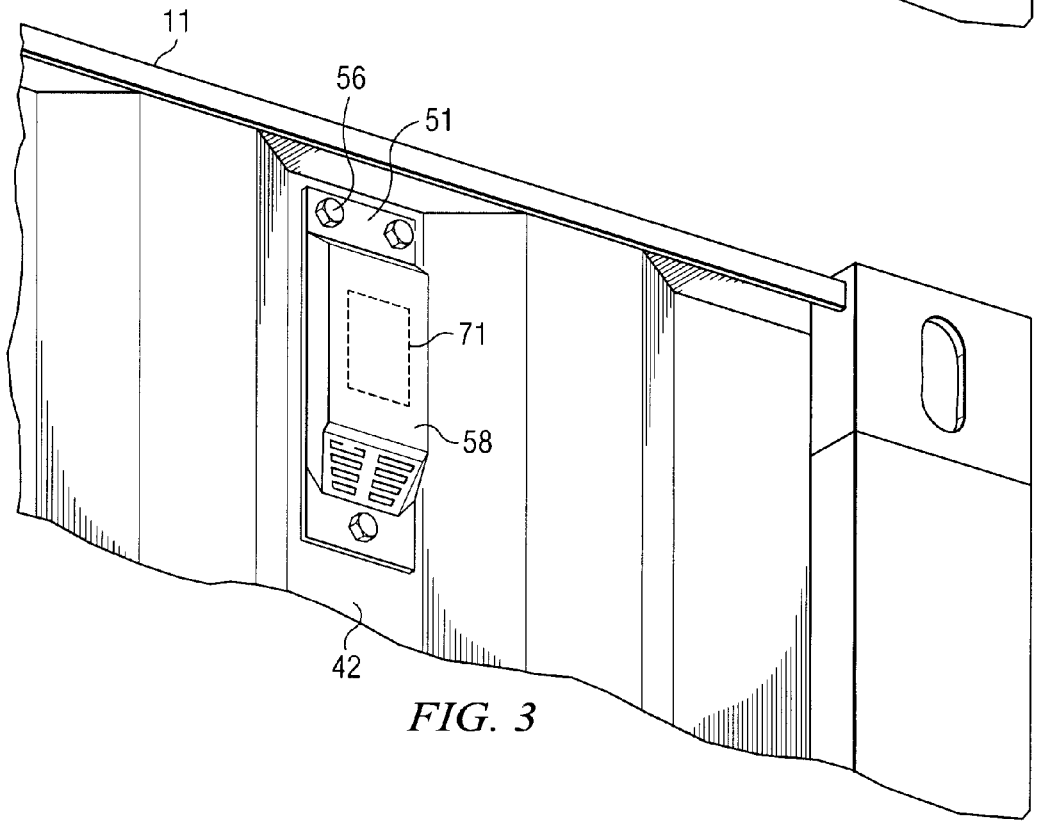
FIG. 3 is a diagrammatic fragmentary perspective view similar to FIG. 2, but showing an alternative embodiment.

FIG. 3 is a diagrammatic fragmentary perspective view similar to FIG. 2, but showing an alternative embodiment. In FIG. 3, the container 11 is identical to the container 11 of FIGS. 1 and 2. The difference between the embodiment of FIG. 3 and the embodiment of FIG. 2 is that the antenna 71 is mounted within the vent cover 51, rather than on the exterior thereof. In FIG. 3, the vent cover 51 is preferably made from a non-metallic material such as a highly durable plastic, so that the vent cover 51 does not attenuate or shield the RF wireless signals that are transmitted and/or received by the antenna 71.

Figure 4:
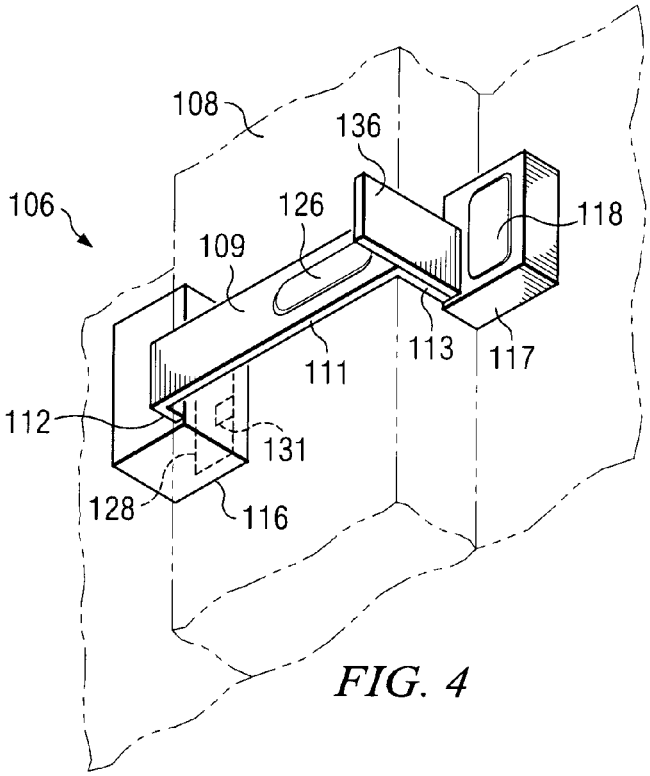
FIG. 4 is a diagrammatic perspective view of a security and monitoring device that embodies aspects of the present invention.
Figure 6:
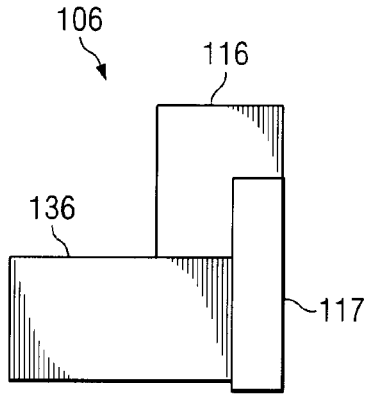
FIG. 6 is a diagrammatic rear view of the device of FIG. 4.
Figure 5:
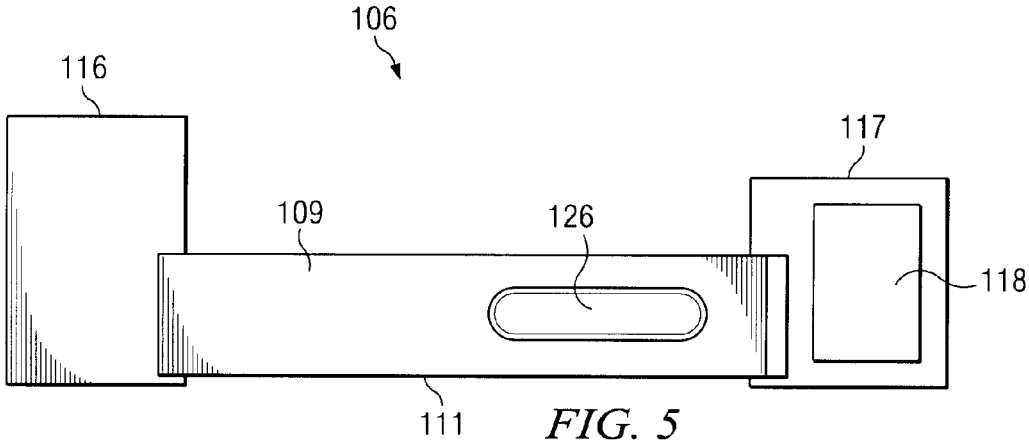
FIG. 5 is a diagrammatic side view of the device of FIG. 4.
Figure 7:
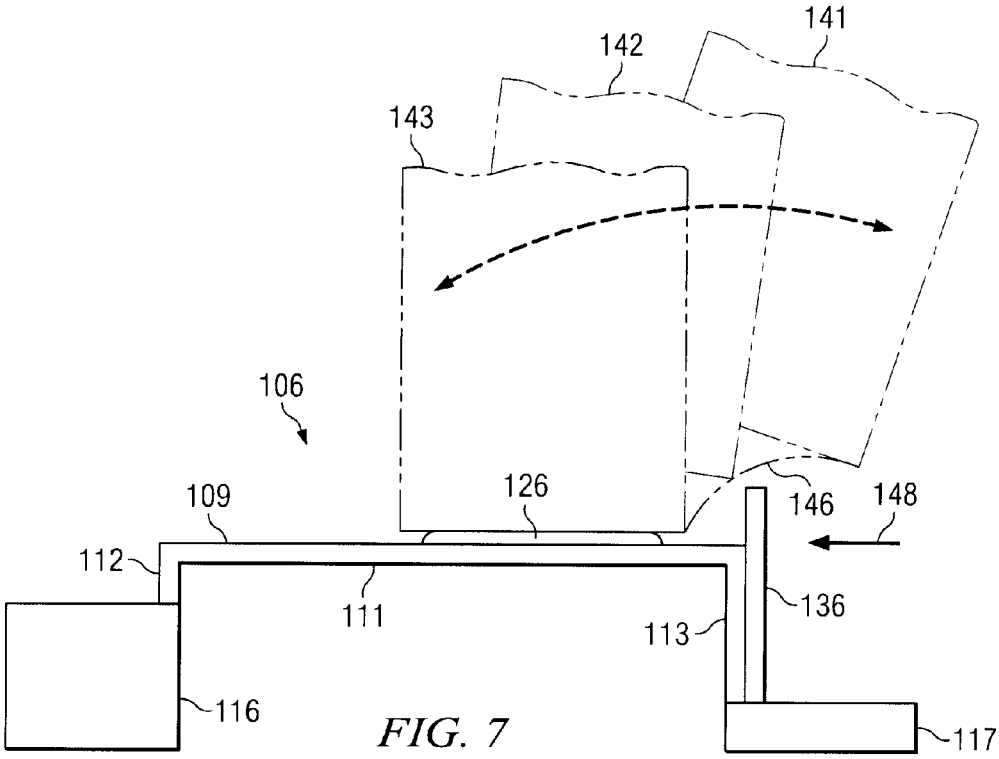
FIG. 7 is a diagrammatic bottom view of the device of FIG. 4.

FIG. 4 is a diagrammatic perspective view of a security and monitoring device 106 that embodies aspects of the present invention. FIG. 5 is a diagrammatic side view of the device 106, FIG. 6 is a diagrammatic rear view of the device 106, and FIG. 7 is a diagrammatic bottom view of the device 106. The device 106 can be removably mounted on a container of the type shown at 11 in FIG. 1. More specifically, although the device 106 is not depicted in FIG. 1, it could be mounted at any of a number of different locations near either of the doors 16 or 17. One suitable location is indicated in FIG. 1 by broken lines at 107. In FIG. 4, the broken lines 108 diagrammatically represent a portion of a door frame that is located within the region 107 of the container, and indicate how the device 106 can be supported on this door frame.

The device 106 has a U-shaped support 109. The support 109 has a central portion 111, and two spaced legs 112 and 113 that project outwardly in the same direction from opposite ends of the central portion 111. When the device 106 is removably supported on the door frame 108 of the container, and when the door 17 is in its closed position, the central portion 111 extends through a gap located between the door 17 and the door frame 108.

The device 106 includes two housings 116 and 117. The housing 116 is fixedly secured to the outer end of the leg 112, and the housing 117 is fixedly secured to the outer end of the leg 113. When the container door 17 is closed, the housing 116 is disposed inside the container, and the housing 117 is disposed outside the container. The housing 117 contains a wireless communication portion of the device 106, one part of which is an antenna 118 provided on an exterior surface of the housing 117.

A pressure sensor 126 is mounted on the central portion 111 of the support 109. When the device 106 is removably supported on the door frame 108 within the region 107, and when the container door 17 is in its closed position, the container door engages and actuates the pressure sensor 126, so that the device 106 knows the door 17 is closed. Although the sensor 126 in the embodiment of FIG. 4 is a pressure sensor, it could alternatively be some other suitable type of detector, such as a switch or a proximity sensor.

The housing 116 contains some circuitry, which is indicated diagrammatically in FIG. 4 by broken lines 128. The circuitry 128 is coupled by not-illustrated wires to the pressure sensor 126, and to the wireless communication portion in the housing 117. When the container 11 is being transported, the doors 16 and 17 should normally remain closed and secured. If the door 17 is opened, the pressure sensor 126 will detect this, and generate a signal to the circuitry 128 in the housing 116. The circuitry 128 can then cause the wireless communication portion to transmit an RF wireless signal from the antenna 118. This wireless signal can be received by a reader of a remote system, so that the remote system is automatically notified that the container door has been opened. If this represents a security breach, the remote system can initiate appropriate action.

The circuitry 128 within the housing 116 can also include one or more sensors, for example as indicated diagrammatically by broken lines at 131. One or more of these sensors can monitor environmental conditions within the container, such as temperature or humidity. If a monitored environmental parameter moves outside an acceptable range, the circuitry 128 can transmit a wireless signal through the antenna 118 in order to notify the remote system. In addition, when the container 11 is loaded with products that have RFID tags, the circuitry in the housing 116 can include a reader that accepts RF signals from the tags, in order to collect information about the products within the container. The circuitry 128 in the housing 116 can then use the antenna 118 to transmit wireless signals that contain some or all of this information.

The device 106 includes a rigid blocking plate 136, which extends transversely to the central portion 111 of the support 109, and approximately parallel to the leg 113 of the support 109. One end of the blocking plate 136 is disposed against and fixedly secured to the leg 113 of the support 109, and the other end thereof projects outwardly beyond the central portion 111 of the support 109. The blocking plate 136 is made of metal, or some other suitable rigid material.

FIG. 7 shows in broken lines a position 143 of the container door 17 when it is in its closed position, and shows two further positions 141 and 142 that the door 17 moves through as it is moving to or from its closed position. It will be noted that, in the closed position 143, the door 17 engages and actuates the pressure sensor 126. It will also be noted that, during movement of the door, an edge portion of the door has a path of travel 146 that extends closely adjacent but does not engage the end of the blocking plate 136. When the door 17 is in its closed position 143, the outer end of the blocking plate 136 makes it difficult or impossible to take a thin object and manually insert it between the container door 17 and the support 109 in the direction indicated by an arrow 148. In contrast, if the device 106 did not have the blocking plate 136, it would be relatively easy to manually insert a thin object between the closed door and the pressure sensor 126, in order to keep the pressure sensor actuated while the container door was opened. The device 106 would thus not know the door had been opened, and would not transmit a wireless alarm signal.

Figure 8:
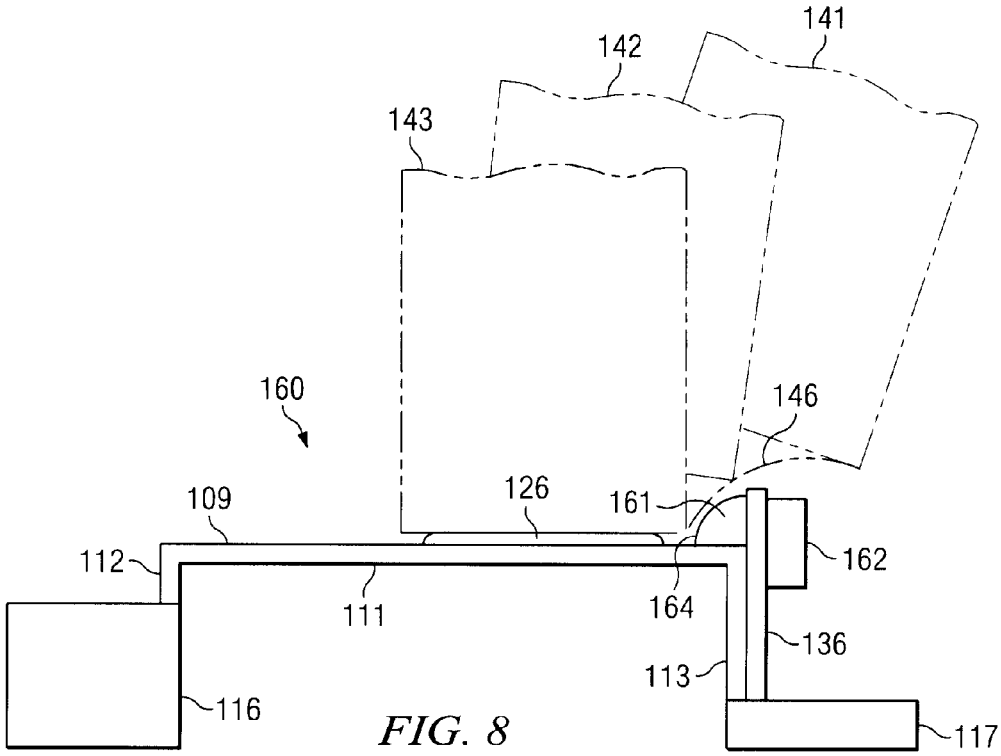
FIG. 8 is a diagrammatic bottom view that is similar to FIG. 7, but that shows a security and monitoring device which is an alternative embodiment of the device of FIG. 7.

FIG. 8 is a diagrammatic bottom view that is similar to FIG. 7, but that shows a security and monitoring device 160 which is an alternative embodiment of the device 106 of FIGS. 4–7. The device 160 of FIG. 8 is generally identical to the device 106, except that it includes some additional structure. In particular, it includes a blocking element 161 and a blocking member 162 that are fixedly secured on opposite sides of the outer end of the blocking plate 136. The blocking element 161 is a quarter of a cylinder, and has its flat surfaces disposed against and fixedly secured to a flat surface on the blocking plate 136 and a flat surface on the central portion 111 of the support 109. The blocking member 162 has a cross-sectional shape that is approximately rectangular, and has a flat surface on one side that is disposed against and fixedly secured to a flat surface of the blocking plate 136.

As the container door 17 moves through the positions 141 and 142 toward its closed position 143, the path of travel 146 of an edge portion of the door extends closely adjacent but does not engage the curved surface 164 on the blocking element 161. When the container door is in the closed position 143, the blocking plate 136, the blocking element 161 and the blocking member 162 collectively serve as a blocking assembly. This blocking assembly makes it difficult or impossible to insert a thin object between the door 17 and the support 109, as discussed above in association with FIG. 7 and the device 106.

Figure 9:
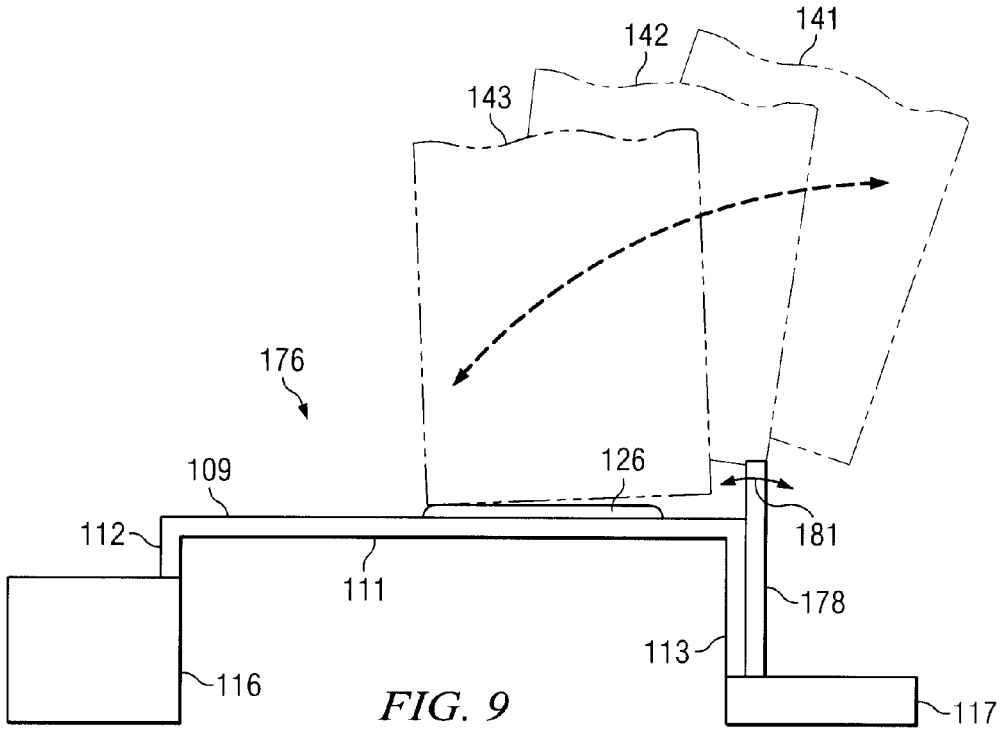
FIG. 9 is a diagrammatic bottom view that is similar to FIG. 7, but that shows a security and monitoring device which is a further alternative embodiment of the device of FIG. 7.

FIG. 9 is a diagrammatic bottom view that is similar to FIG. 7, but that shows a security and monitoring device 176 which is a further alternative embodiment of the device 106 of FIG. 7. The device 176 is generally identical to the device 106, except that a blocking plate 178 is provided in place of the blocking plate 136 of FIG. 7. The difference is that the blocking plate 178 is not rigid like the plate 136, but has the ability to flex slightly, so as to permit a very small amount of movement of the outer end thereof, as indicated diagrammatically by a double-headed arrow 181. The blocking plate 178 may, for example, be made of relatively stiff spring steel.

As the container door 17 pivots through the intermediate positions 141 and 142 toward its closed position 143, an edge portion of the door engages and moves the outer end of the blocking plate 178 a small amount in a leftward direction in FIG. 9. Then, when the door edge portion has passed the end of the blocking plate 178, the inherent resilience of the blocking plate 178 causes the outer end thereof to return to its original or normal position, which is the position shown in FIG. 9. Similarly, when the container door 17 is being opened and moves from the closed position 143 through the positions 142 and 141, the edge portion of the door engages and moves the outer end of the blocking plate 178 a small distance in a rightward direction in FIG. 9. Then, when the edge portion has passed the end of the blocking plate 178, the inherent resilience of the blocking plate 178 causes the outer end thereof to return to the normal position shown in FIG. 9. When the container door is in its closed position 143, the outer end of the blocking plate 178 obstructs easy access to the region between the container door and the support 109, in the same manner already discussed above in association with FIG. 7 and the device 106.

Figure 10:
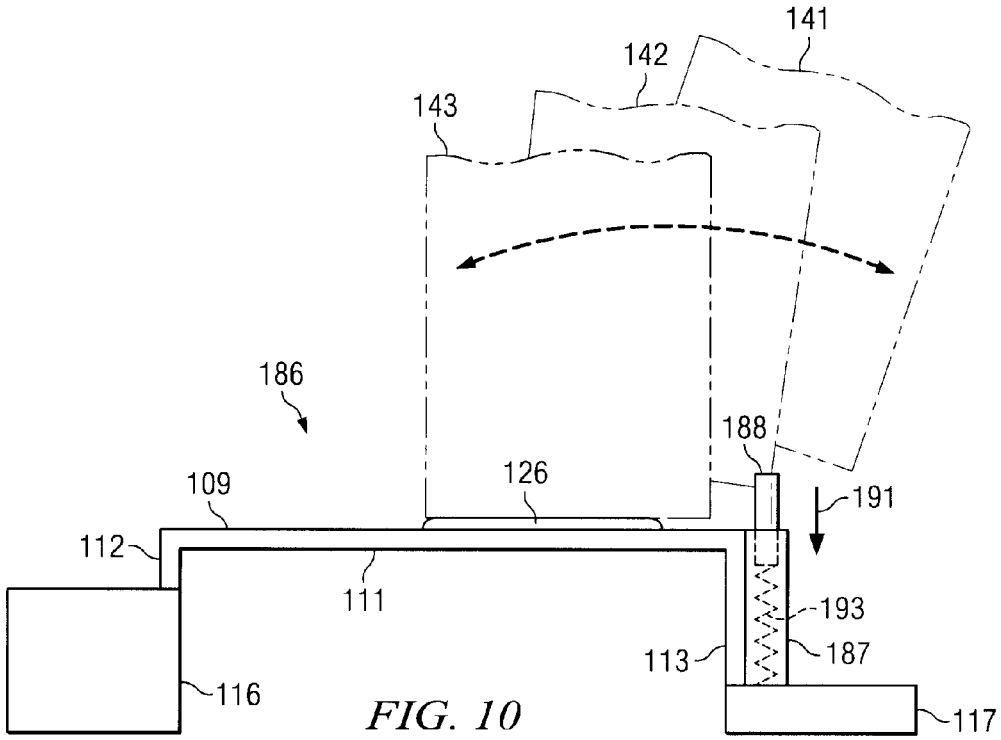
FIG. 10 is a diagrammatic bottom view that is similar to FIG. 7, but that shows a security and monitoring device which is still another alternative embodiment of the device of FIG. 7.

FIG. 10 is a diagrammatic bottom view that is similar to FIG. 7, but that shows a security and monitoring device 186 which is still another alternative embodiment of the device 106 of FIG. 7. The device 186 is generally identical to the device 106, except for the differences described below. In particular, the blocking plate 136 has been replaced with a different type of blocking structure, which includes a base 187 that is disposed against and fixedly secured to the portion 113 of the support 109. A blocking part 188 is supported by the base 187 for limited reciprocal linear movement, in directions parallel to an arrow 191.

A coil spring is shown diagrammatically at 193, and is disposed within the base 187. The spring 193 resiliently urges movement of the blocking part 188 in a direction opposite the arrow 191. FIG. 10 shows an extended position of the blocking part 188, in which it projects transversely outwardly beyond the central portion 111 of the support 109. From this extended position, the blocking part 188 can be moved in the direction of the arrow 191 against the resilience of the spring 193, to a retracted position in which the outer end of the blocking part 188 is approximately flush with the outer end of the base 187. The spring 193 is selected to be relatively strong, so that it is difficult or impossible to manually move the blocking part 188, even with a screwdriver or other small tool.

As the container door 17 pivots through the intermediate positions 141 and 142 toward its closed position 143, an edge portion of the door engages the outer end of the blocking part 188, and moves the blocking part 188 in the direction of the arrow 191 against the force of the spring 193. Since the device 186 is disposed in the region of the pivot axis 19 of the door 17, the width of the door provides a significant lever advantage that permits the door to move the blocking part 188, despite the fact that the spring 193 is relatively strong. Once the edge portion of the door has moved past the blocking part 188, the spring 193 returns the blocking part 188 to its original or normal position, which is shown in FIG. 10.

When the container door is later opened, and moves away from the closed position 143 through the intermediate positions 142 and 141, the edge portion of the door again engages the part 188 and moves it in the direction of the arrow 191 against the force of the spring 193. Then, after the door edge portion has moved out of engagement with the blocking part 188, the spring 193 returns the blocking part 188 to its normal position. When the container door is in its closed position 143, the blocking part 188 restricts access to the region between the container door and the support 109, in the same manner described above in association with FIG. 7 and the device 106.

Figure 11:
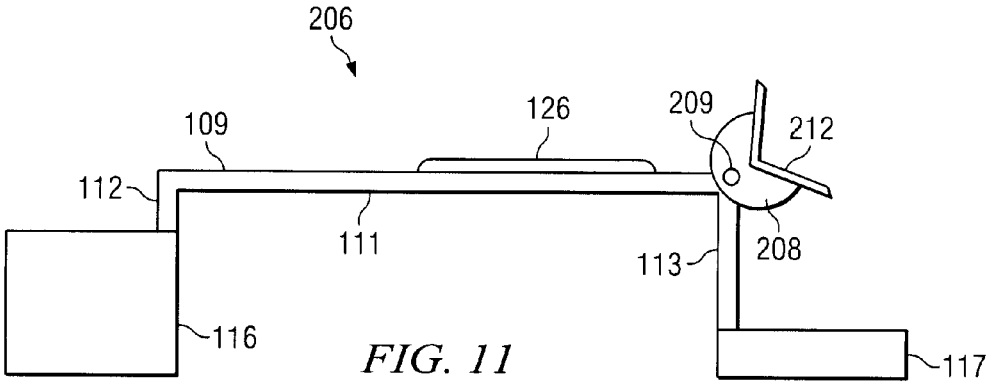
FIG. 11 is a diagrammatic bottom view that is similar to FIG. 7, but that shows a security and monitoring device which is yet another alternative embodiment of the device of FIG. 7.
Figure 12:
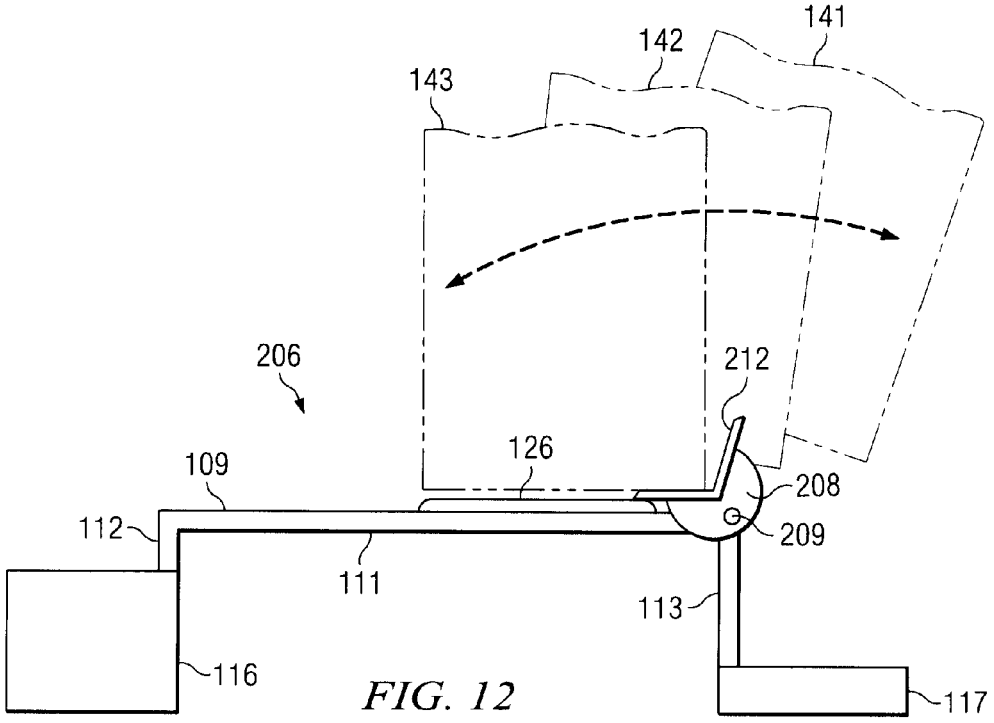
FIG. 12 is a diagrammatic bottom view similar to FIG. 11, but showing a different operational position of the device of FIG. 11.

FIG. 11 is a diagrammatic bottom view that is similar to FIG. 7, but that shows a security and monitoring device 206 which is still another alternative embodiment of the device 106 of FIG. 7. FIG. 12 is a diagrammatic bottom view similar to FIG. 11, but shows a different operational position of the device 206. The device 206 of FIGS. 11 and 12 is generally identical to the device 106 of FIG. 7, except that the blocking plate 136 has been replaced with a different blocking arrangement. More specifically, a blocking member 208 is supported on the support 109 for reciprocal pivotal movement about a pivot access 209 that extends parallel to the pivot axis 19 (FIG. 1) of the container door 17. The blocking member 208 can pivot between a ready position that is shown in FIG. 11, and a retracted position that is shown in FIG. 12. The blocking member 208 has a V-shaped recess 212.

As the container door 17 is pivoted from its open position toward its closed position 143, an edge portion of the door engages the recess 212, and pivots the blocking member 208 in a counterclockwise direction from the ready position of FIG. 11 to the retracted position of FIG. 12. It will be noted from FIG. 12 that, when the container door is in its closed position 143, the pressure sensor 126 is engaged by and actuated by a portion of the blocking member 208, rather than by the container door 17. Instead of having the blocking member 208 actuate the pressure sensor 126, it would alternatively be possible for a sensor arrangement to be integrated into the pivot mechanism for the blocking member 208. As yet another alternative, instead of having the blocking member 208 actuate the pressure sensor 126, the door 17 could directly actuate the pressure sensor 126, as in the embodiments of FIGS. 4–10. When the blocking member 208 is in the retracted position shown in FIG. 12, it prevents insertion of an object between the container door 17 and the support part 109, in the same manner described above in association with FIG. 7 and the device 106.

When the container door is opened and moves away from its closed position 143, the edge portion of the door pivots the blocking member 208 in a clockwise direction from the retracted position of FIG. 12 to the ready position of FIG. 11, and then the edge portion moves out of engagement with the recess 212 as the door continues to move toward its open position. It is optionally possible to provide a not-illustrated detent mechanism, which yieldably resists pivotal movement of the blocking member 208 away from the ready position of FIG. 11.

Figure 13:
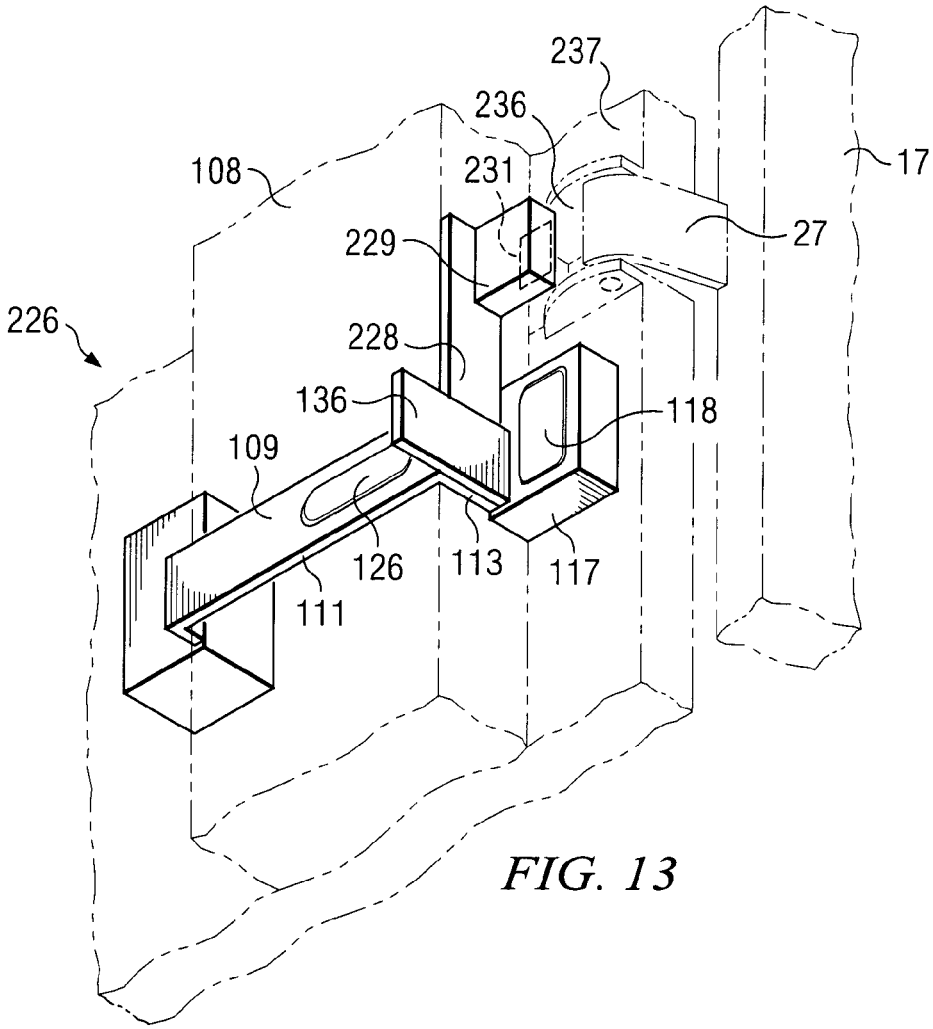
FIG. 13 is a diagrammatic fragmentary perspective view of a security and monitoring device that is an alternative embodiment of the device of FIG. 4.

FIG. 13 is a diagrammatic fragmentary perspective view of a security and monitoring device 226 which is an alternative embodiment of the device 106 of FIG. 4. The device 226 is generally identical to the device 106, except that the device 226 includes some additional structure, as explained below. More specifically, in FIG. 13, the portion 113 of the support 109 has an upward extension at 228, and has a further housing 229 that is fixedly mounted on the extension 228. An antenna 231 is provided on the housing 229, and is electrically coupled by not-illustrated wires to the circuitry 128 in the housing 116 (FIG. 4). The hinge 27 of the container 11 includes an opening 236 through a wall portion 237 of the container. The device 226 is mounted on the door frame 108 in a position so that the housing 229 and the antenna 231 are aligned with the opening 236.

The antennas 118 and 231 can thus transmit wireless signals in opposite directions, and this reduces the extent to which the range of wireless signals is greater in some directions than in other directions. Stated differently, since many devices have "line of sight" limitations in regard to their capability to interact with other devices through wireless signals, this dual antenna arrangement uses a much larger portion of the potential 360° communication profile, and thereby improves communications between the device 226 and the external world, while achieving better system performance.

Figure 14:
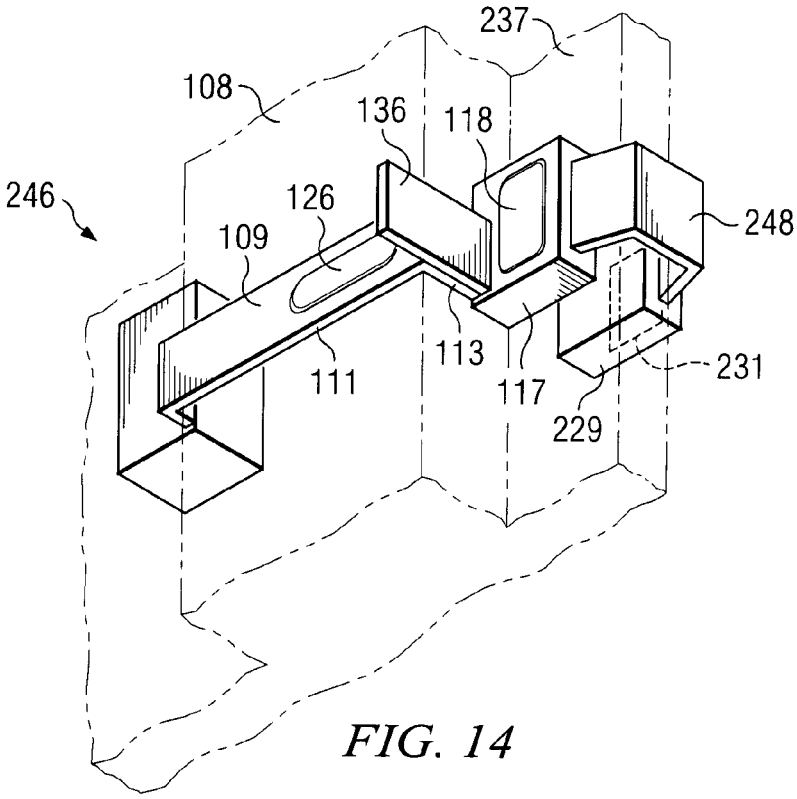
FIG. 14 is a diagrammatic fragmentary perspective view of a security and monitoring device that is a further alternative embodiment of the device of FIG. 4.

FIG. 14 is a diagrammatic fragmentary perspective view of a security and monitoring device 246 that is a further alternative embodiment of the device 106 of FIG. 4. The device 246 is generally identical to the device 106, except for some additional structure that is described below. More specifically, like the device 226, the device 246 includes an additional housing 229 with an additional antenna 231. In addition, an approximately C-shaped support 248 has one end fixedly secured to the housing 117, and its other end fixedly secured to the housing 229, so as to maintain the housings 117 and 229 in a spaced relationship, with the antennas 118 and 231 facing in opposite directions. When the device 246 is removably installed on a container, the housings 117 and 229 are disposed on opposite sides of the wall portion 237 of the container. There are not-illustrated wires that extend along the support 248, in order to facilitate an electrical coupling of the antenna 231 with the circuitry 128 in the housing 116 (FIG. 4). This dual antenna arrangement has advantages that are similar to those described above in association with the device 226 of FIG. 13.

Figure 15:
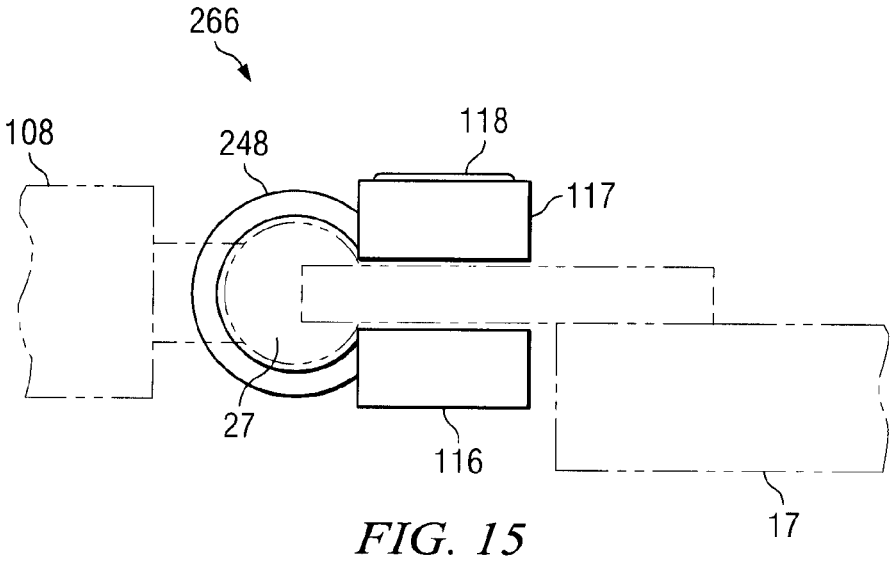
FIG. 15 is a diagrammatic top view of a security and monitoring device that is yet another alternative embodiment of the device of FIG. 4.

FIG. 15 is a diagrammatic top view of a security and monitoring device 266, which is yet another alternative embodiment of the device 106 of FIG. 4. The device 266 has a C-shaped support 248, in the form of a resiliently flexible clip that is almost circular. One end of the support 248 is secured to the housing 116, and the other end of the support 248 is secured to the housing 117 with the antenna 118. The support 248 is designed and sized so that it can resiliently and removably grip a portion of the hinge 27 of the container door 17, with the housing 117 disposed on the outer side, and the housing 116 disposed on the inner side.

Although the support 248 in FIG. 15 is a resilient clip that resiliently grips the hinge 27, the support 248 could alternatively be held in place in some other suitable manner, for example by use of a cam lock, an adhesive, or a traditional mechanical fastening arrangement such as bolts or screws. The device 266 could be installed on a container during factory assembly of the container, or could be installed at a later time as a retrofit. The device 266 could optionally include a not-illustrated door status sensor that cooperates with a part of the hinge 27 in order to detect the pivotal position of the container door.

Although several selected embodiments have been illustrated and described in detail, a variety of substitutions and alterations are possible without departing from the spirit and scope of the present invention, as defined by the following claims.

What is claimed is:

1. An apparatus comprising a device that includes:

a support having a selected portion configured to extend through a gap between a door frame and a door;

a blocking portion supported on the support and adapted to obstruct access to the gap; and a detector supported on said support at a location thereallong which is on the same side of said blocking portion as said selected portion.

2. An apparatus according to claim 1, wherein said blocking portion includes a blocking part stationarily supported on said support and projecting transversely outwardly with respect to said selected portion adjacent one end thereof, said blocking part being configured so that, when said device is supported on a door frame and a door is moving between open and closed positions, a door edge passes closely adjacent said blocking part but without engaging the blocking part.

3. An apparatus according to claim 2, wherein said blocking part includes, on a side thereof facing said selected portion, a curved surface that is shaped so that, when the device is supported on a door frame, a path of movement of the door edge extends closely adjacent at least a portion of the curved surface.

4. An apparatus according to claim 1, wherein said blocking portion includes a blocking part supported on said support and projecting transversely outwardly with respect to said blocking portion adjacent one end thereof, said blocking part having a limited degree of flexibility that permits limited movement of an outer end thereof, and being configured so that, when said device is supported on a door frame and a door is moving between open and closed positions, the outer end of the blocking part is engaged and moved by a door edge and then is resiliently returned to its normal position.

5. An apparatus according to claim 1, wherein said blocking portion includes a blocking part movably supported on said support adjacent one end of said selected portion, said device being configured so that, when said device is supported on a door frame and a door is moving between open and closed positions, the blocking part is engaged and moved by a door edge.

6. An apparatus according to claim 5, wherein said blocking part is movable approximately transversely with respect to said selected portion; and wherein said blocking portion includes a resilient portion that yieldably urges said blocking part toward a normal position, so that when said device is supported on a door frame and a door is moving between open and closed positions, the blocking part is engaged and moved by a door edge and then is returned to its normal position by the resilient portion.

7. An apparatus according to claim 5, wherein said blocking part has a recess and is supported on said support for pivotal movement about an axis between first and second positions, so that when said device is supported on a door frame and a door moves from an open position to a closed position, a door edge extending approximately parallel to said axis moves into the recess and pivots said blocking part from said first position to said second position, and so that when the door moves from the closed position to the open position, the door edge pivots the blocking part from the second position to the first position and then moves out of the recess.

8. An apparatus according to claim 7, wherein the detector is responsive to movement of the blocking part.

9. An apparatus according to claim 1, wherein said support is approximately U-shaped and has spaced first and second portions and a third portion, said first and second portions each projecting outwardly in a selected direction from a respective end of said third portion, said third portion including said selected portion, and said blocking portion being disposed in the region of one of the ends of said third portion.

10. An apparatus according to claim 1, including a wireless communication portion supported on said support on a side of said blocking portion remote from said selected portion.

11. An apparatus according to claim 10, wherein said wireless communication portion includes an antenna.

12. An apparatus according to claim 1, including a further portion supported on said support, said further portion being on the same side of said blocking portion as said selected portion, and said further portion having circuitry that is coupled to said detector.

13. An apparatus according to claim 12, wherein said detector is one of a switch and a sensor.

14. An apparatus according to claim 12, wherein said detector is responsive to the position of a door.

15. An apparatus according to claim 12, wherein said detector is a pressure sensor positioned to be engaged by a door when the device is supported on a door frame and the door is in a closed position.

* * * * *